US011491368B2

(12) United States Patent
Hao

(10) Patent No.: US 11,491,368 B2
(45) Date of Patent: Nov. 8, 2022

(54) FOLDABLE PUSH-UP BOARD

(71) Applicant: Szu-Chia Hao, Allen, TX (US)

(72) Inventor: Szu-Chia Hao, Allen, TX (US)

( * ) Notice: Subject to any disclaimer, the term of this patent is extended or adjusted under 35 U.S.C. 154(b) by 0 days.

(21) Appl. No.: 17/368,510

(22) Filed: Jul. 6, 2021

(65) Prior Publication Data

US 2022/0008785 A1 Jan. 13, 2022

(51) Int. Cl.
*A63B 23/12* (2006.01)
*A63B 21/00* (2006.01)
*A63B 23/035* (2006.01)

(52) U.S. Cl.
CPC .... *A63B 23/1236* (2013.01); *A63B 21/00047* (2013.01); *A63B 21/4035* (2015.10); *A63B 23/03516* (2013.01); *A63B 2210/50* (2013.01)

(58) Field of Classification Search
CPC ..... A63B 21/00047; A63B 21/4035; A63B 23/03516; A63B 23/1236; A63B 2210/50
See application file for complete search history.

(56) References Cited

U.S. PATENT DOCUMENTS 4,610,448 A * 9/1986 Hill ..... A63B 21/4035 482/141
5,226,868 A * 7/1993 Montgomery ..... A63B 21/4035 482/141
6,129,651 A * 10/2000 Denaro ..... A63B 21/00047 482/141
6,716,145 B1 * 4/2004 Manailovich ..... A63B 21/4035 482/141
7,134,987 B2 * 11/2006 Goldstein ..... A63B 21/4045 482/141
8,702,570 B1 * 4/2014 DelPriore ..... A63B 23/0355 482/52
9,492,705 B2 * 11/2016 Hong ..... A63B 21/00069
2005/0148448 A1 * 7/2005 Mersch ..... A63B 21/4035 482/141
2011/0028274 A1 * 2/2011 Chong ..... A63B 21/4035 482/141
2016/0067545 A1 * 3/2016 Hong ..... A63B 21/0552 482/138
2021/0339078 A1 * 11/2021 Akeel ..... A63B 24/0087

* cited by examiner

*Primary Examiner* — Joshua Lee
(74) *Attorney, Agent, or Firm* — Sul Lee

(57) ABSTRACT

A foldable push-up board includes a base plate, two handles that are each detachably fixed to the base plate, and at least one anti-slip plug detachably fixed to the base plate, the bottom portion of the anti-slip plug protruding from the bottom-facing surface of the base plate. The base plate has a first plate portion, a second plate portion, and a hinge connecting the first plate portion and the second plate portion. Each handle has a U-shaped connecting section having protruding posts configured to be detachably fixed to the base plate, and a holding section that closes an opening of the U-shaped connecting section.

9 Claims, 3 Drawing Sheets

FOLDABLE PUSH-UP BOARD

TECHNICAL FIELD

The present relates to the technical field of fitness equipment, in particular to a foldable push-up board.

BACKGROUND ART

With the continuous improvement of living standards, people's demand for fitness is increasing. Push-ups, as a common fitness exercise, has become very popular. Push-ups mainly exercise the muscles of the upper limbs, the waist and the abdomen, especially the chest muscles.

As a device for practicing push-ups, a push-up board is a type of common fitness equipment used when people do push-ups. Existing push-up boards often have two fixed handles mounted on the base plate. In this way, the distance between the two handles is fixed, which makes it inconvenient to choose different distances and positions of hands for push-up exercises. In addition, the existing push-up boards also have a disadvantage that they may easily slip when in use, which may affect the safety of use. Some push-up boards are also bulky and thus require a lot of space. As a result, they are not easy to carry.

SUMMARY

In view of the above problems, the present utility model provides a foldable push-up board that allow handles to be placed in different configurations and that is easy to carry, non-slip and easy to store, which solves the technical problems of the above-mentioned defects of the existing push-up boards.

In order to achieve the above objects, an embodiment of the technical solution adopted by the present utility model is to provide a foldable push-up board, which includes:

A bottom board, which includes a first board body and a second board body hinged together, where symmetrical positions on the first board body and the second board body are respectively provided with hand-carrying holes arranged close to respective edges of the bottom board;

Two handles, where the two handles are detachably fixed to the first board body and the second board body, each of the handles includes a U-shaped connecting section fixed to the bottom board and a holding section that closes an opening of the U-shaped connecting section, the holding section includes two opposite inwardly inclined rectangular surfaces, and an upper surface and a lower surface connecting the two rectangular surfaces; and anti-slip plugs, which are detachably fixed in the bottom board, and with a bottom surface of the anti-slip plug protruding from a lower surface of the bottom board.

In some embodiments of the present utility model, the first board body and the second board body are each provided with at least two matching slots, and a bottom portion of each of the handles is formed with at least two protruding posts that match and are inserted into the matching slots.

In some embodiments of the present utility model, a ring groove is formed on the first board body, a first matching slot and a second matching slot are respectively provided at a center of the ring groove and a tangent position of the ring groove, and a distance between the first matching slot and the second matching slot is the same as a distance between the two protruding posts in the bottom portion of the handle.

In some embodiments of the present utility model, the number of the second matching slot is six, and the six second matching slots are arranged in a regular hexagon.

In some embodiments of the present utility model, the bottom board is further provided with matching slots for vertically fixing the handles.

In some embodiments of the present utility model, the number of the anti-slip plugs is a plurality, and the plurality of anti-slip plugs are staggered from the matching slots.

In some embodiments of the present utility model, the anti-slip plugs are fixed to the bottom board by insertion.

In some embodiments of the present utility model, the anti-slip plugs are symmetrically distributed at bottom portions of the first board body and the second board body.

In some embodiments of the present utility model, a bottom portion of the bottom board is provided with criss-crossed enhancement ribs.

Due to the adoption of the above technical solutions, the present utility model has the following beneficial effects:

(1) The foldable push-up board provided in the present utility model can be folded in half to save storage space. It has hand-carrying holes on the bottom board, which makes it easy to carry. There are anti-slip plugs in the bottom portion of the bottom board, which can improve the safety of use and prevent the bottom board from slipping during use. The arrangement of the first matching slot, the second matching slot and the third coordination slot of the utility model is beneficial to save the space occupied by the matching slots, can adapt to different training requirements, and has strong functionality. The third matching slots are arranged on two sides of the ring groove, and the second matching slots are arranged in a regular hexagon shape, which makes it easy for a user to select a suitable handle distance as needed. Thus, the present utility model has good adaptability.

(2) The holding section of the handle of the present utility model is in the shape of an inclined rectangle, which is ergonomic and superior to the circular holding grips on the market, and can prevent the hands from slipping during use.

(3) The foldable push-up board of the present utility model has a simple structure, is convenient to manufacture, and can help to reduce the costs.

According to an embodiment, a foldable push-up board includes a base plate, two handles each configured to be detachably fixed to the base plate, and at least one anti-slip plug detachably fixed to the base plate, wherein a bottom portion of the anti-slip plug protrudes from a bottom-facing surface of the base plate. The base plate has a first plate portion comprising a first hand-carrying hole, a second plate portion comprising a second hand-carrying hole, and a hinge connecting the first plate portion and the second plate portion, the first hand-carrying hole and the second hand-carrying hole located at each respective end of the first plate portion and the second plate portion such that a single hand-carrying handle is formed the base plate is completely folded about the hinge. Each handle has a U-shaped connecting section comprising a plurality of protruding posts configured to be detachably fixed to the base plate, and a holding section that closes an opening of the U-shaped connecting section, the holding section comprising an upper surface, a bottom surface, and two inwardly angled posts connecting the upper surface and the bottom surface.

According to an embodiment, each plurality of protruding posts comprises a first protruding post and a second protruding post, wherein the first protruding post is located at a predetermined length from the second protruding post.

According to an embodiment, the first plate portion further comprises a first center positioning slot surrounded by a first plurality of surrounding positioning slots, each surrounding positioning slot of the first plurality of surrounding positioning slots placed at the predetermined length from the first center positioning slot and also adjacent surrounding positioning slots, and the second plate portion further comprises a second center positioning slot surrounded by a second plurality of surrounding positioning slots, each surrounding positioning slot of the second plurality of surrounding positioning slots placed at the predetermined length from the second center positioning slot and also adjacent surrounding positioning slots.

According to an embodiment, the first plurality of surrounding positioning slots comprises six surrounding positioning slots arranged in a regular hexagon, and the second plurality of surrounding positioning slots comprises six surrounding positioning slots arranged in a regular hexagon.

According to an embodiment, the first plate portion and the second plate portion each comprises a corner positioning slot located at the predetermined distance from a respective surrounding positioning slot for fixing the handles in a direction that is perpendicular to the length of the base plate.

According to an embodiment, the number of the at least one anti-slip plug is plural and the plurality of anti-slip plugs is arranged in a staggered manner with respect to the positioning slots.

According to an embodiment, the anti-slip plug is fixed to the base plate by insertion.

According to an embodiment, the anti-slip plugs are symmetrically distributed at bottom portions of the first plate portion and the second plate portion.

According to an embodiment, a bottom portion of the base plate is provided with crisscrossed enhancement ribs.

BRIEF DESCRIPTION OF THE ACCOMPANYING DRAWINGS

So that the manner in which the above recited features of the present disclosure can be understood in detail, a more particular description of the disclosure, briefly summarized above, may have been referred by embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

These and other features, benefits, and advantages of the present disclosure will become apparent by reference to the following text figure, with like reference numbers referring to like structures across the views, wherein.

DETAILED DESCRIPTION

In order to facilitate the understanding of the present utility model, the following description will be provided in conjunction with the drawings and embodiments.

Figure 1:
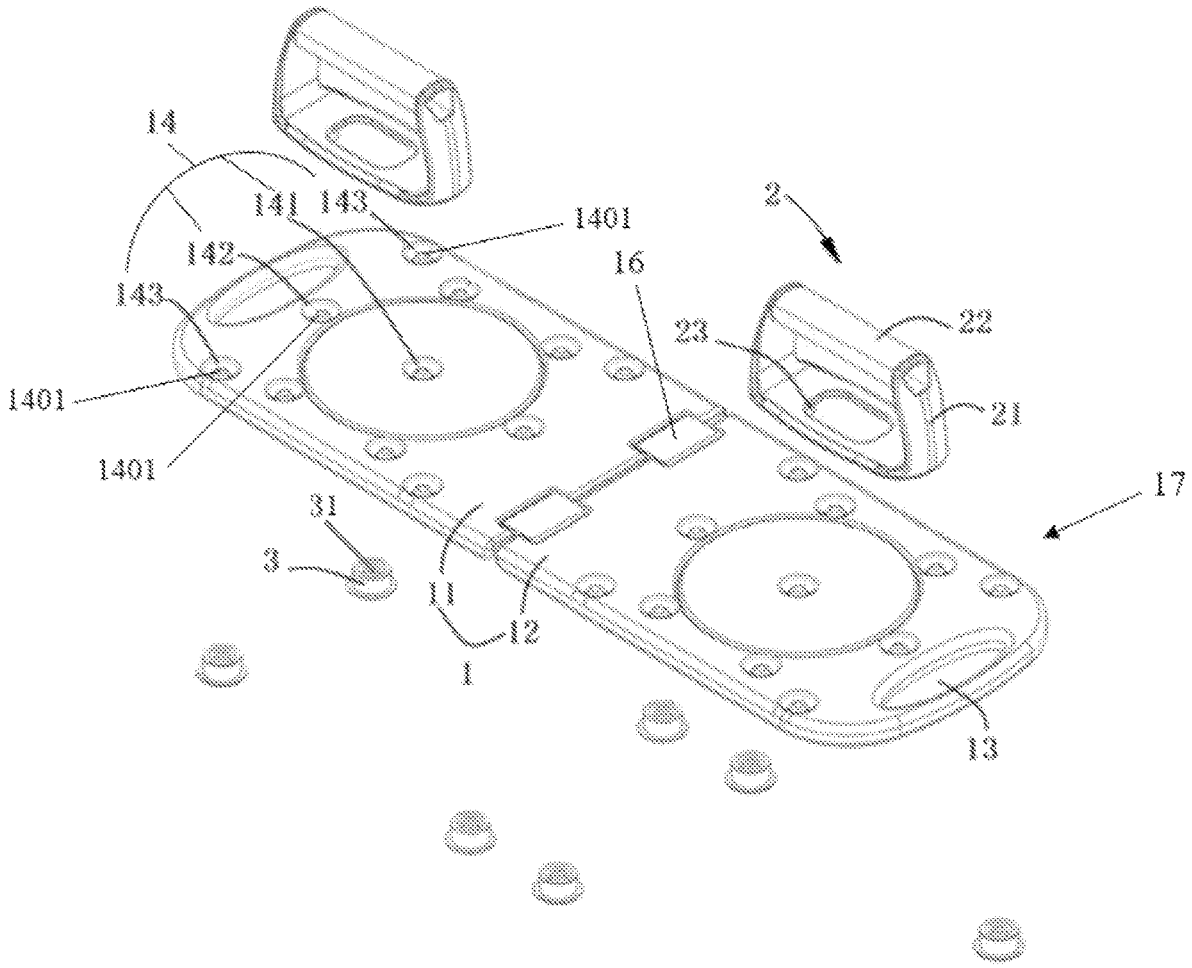
FIG. 1 illustrates an exploded view of a foldable push-up board, in accordance with an embodiment of the present disclosure.

With reference to FIG. 1, an embodiment of the present utility model provides a foldable push-up board 17, which comprises: a base plate 1, at least one handle 2, and at least one anti-slip plug 3. According to an embodiment, the foldable push-up board 17 may comprise two handles. The base plate 1, having a first plate portion 11 and a second plate portion 12, can be folded. According to an embodiment, the first plate portion 11 of the base plate 1 may be folded over the second plate portion 12 of the base plate to save storage space. The base plate 1 further comprises a hand-carrying cavity 13 at each opposite end of the base plate 1 so that the base plate 1 is convenient to carry when the first plate portion 11 is folded over the second plate portion 12 such that the hand-carrying cavities 13 form a handle. A bottom portion of the base plate 1 is provided with one or more anti-slip plugs 3, which can improve the safety of use and prevent the base plate 1 from slipping during use. The anti-slip plugs 3 may be formed of a material that has traction such as rubber or may be formed to have a bottom surface texture that has traction. According to an embodiment, holding section 22 of each handle 2 is ergonomic to prevent the hands from slipping during use. According to an embodiment, the holding sections 22 of the handles 2 may be formed of a material that promotes better grip. According to an embodiment the ergonomic surface of the holding section 22 is contoured. According to an embodiment, the top surface of the holding section 22 is curved in a direction perpendicular to the lengthwise direction in order to improve grip.

Figure 3:
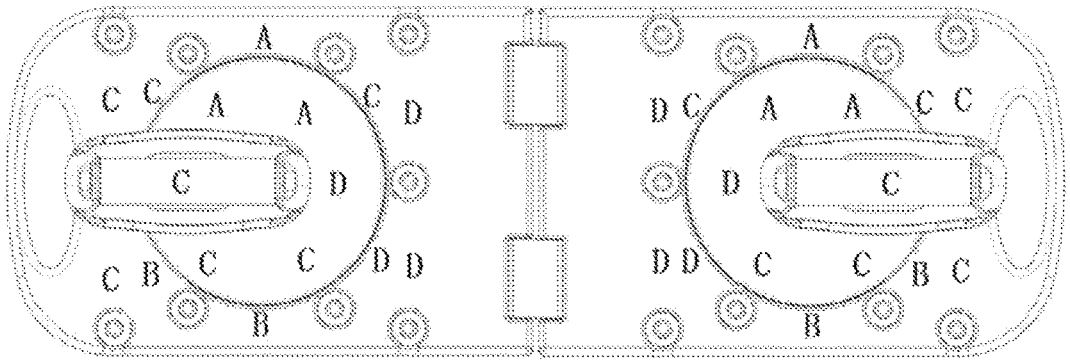
FIG. 3 illustrates an orthogonal top view of a foldable push-up board, in accordance with an embodiment of the present disclosure.
Figure 4:
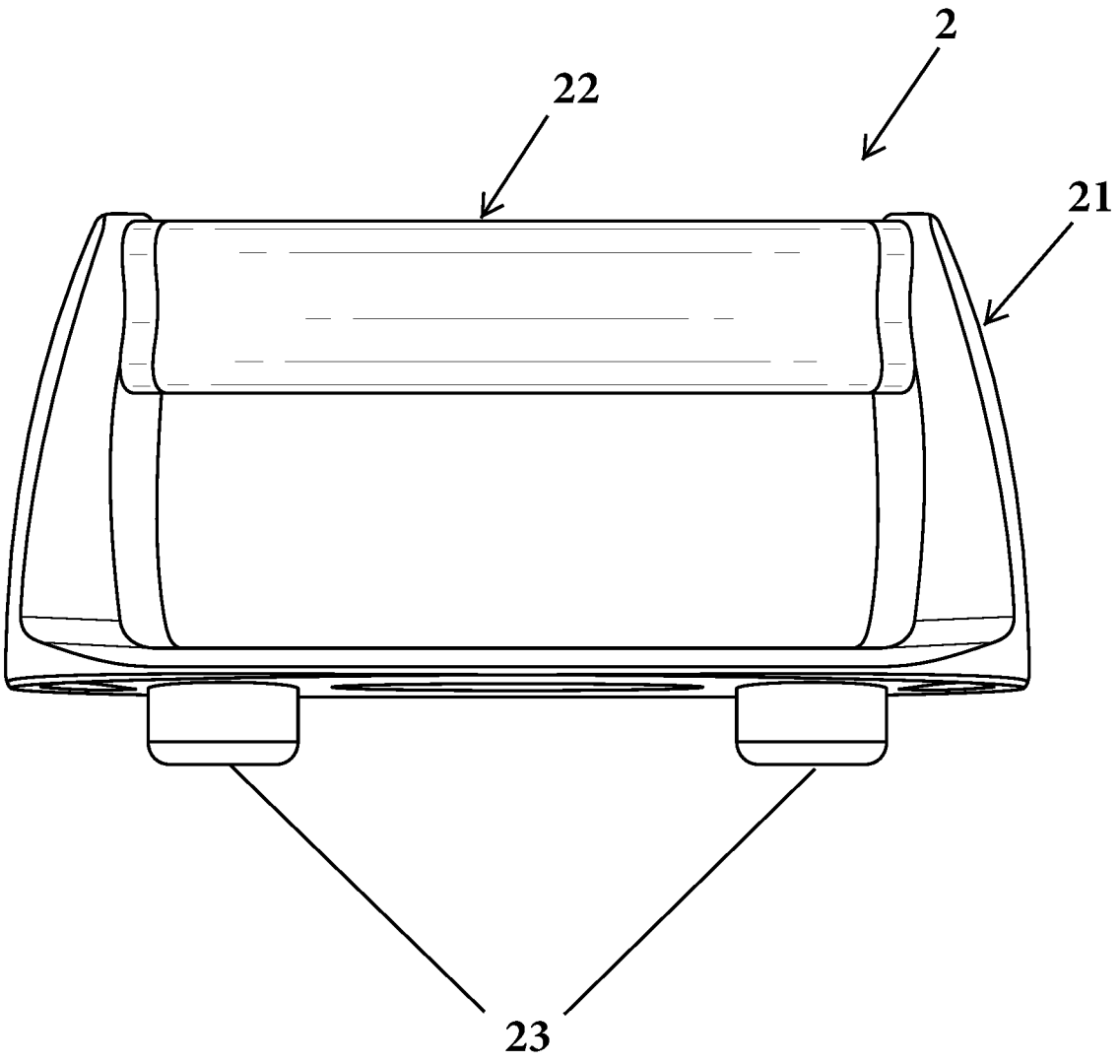
FIG. 4 illustrates a side view of a handle, in accordance with an embodiment of the present disclosure.

According to an embodiment, the base plate 1 comprises the first plate portion 11 and the second plate portion 12. The first plate portion 11 and the second plate portion 12 are connected by one or more hinges such that each of the first plate portion 11 and the second plate portion 12 can be folded relative to the other plate portion. Each hand-carrying hole 13 is symmetrically located at each respective end of the first plate portion 11 and the second plate portion 12. Further, the hand-carrying holes 13 are provided on opposing sides of a connecting part between the first plate portion 11 and the second plate portion 12. The hinge 16 connecting the first plate portion 11 and the second plate portion 12 facilitates the folding of the base plate 1 so that the foldable push-up board 17 can be stored easily when not in use so as to save space. When in use, the first plate portion 11 and the second plate portion 12 can be unfolded and arranged on a floor for exercise. The symmetrically arranged hand-carrying holes 13 can provide points that are easy to hold when carrying the foldable push-up board 17*e* an embodiment of the present utility model, a plurality of positioning slots 14 are provided on each of the first plate portion 11 and the second plate portion 12. According to an embodiment the plurality of positioning slots 14 of the first plate portion 11 are positioned to mirror the plurality of positioning slots 14 of the second plate portion 12. A bottom portion of each handle 2 comprises a set of at least two protruding posts 23 that can be inserted into a set of positioning slots 14 that matches the pattern of the protruding slots 23 among the plurality of positioning slots 14 in each of the first plate portion 11 and the second plate portion 12. FIG. 4 illustrates an embodiment in which each handle 2 has two protruding spots 23 at a fixed distance from each other. Once the protruding slots 23 of a handle 2 is inserted into the matching set of positioning slots 14, the handle 2 is fixed in place until the protruding slots 23 are removed from the positioning slots 14. In an embodiment, the structure of the positioning slots 14 is as shown in FIGS. 1 and 3. According to an embodiment, each positioning slot 14 comprises a cylindrical groove and a concentric post 1401 located in the cylindrical groove. According to an embodiment, each of the protruding posts 23 has a hollow center cavity such that the protruding post 23 is shaped like a cylinder, and each positioning slot 14 has a concentric post 1401 protruding orthogonally from the center of the positioning slot 14 to form a hollow ring. According to an embodiment, the concentric post 1401 may be cylindrical or conical in shape. The hollow ring has a thickness for snugly accommodating the protruding post 23 that has a hollow center to reduce the possibility of the handle 2 accidentally being lifted away from the base plate 1 during use.

In an embodiment of the present utility model, a plurality of the positioning slots 14 is provided on each of the first plate portion 11 and the second plate portion 12, and certain pairs of positioning slots 14 can be classified into different groups as described below. A center positioning slot 141 is provided at or near the center of each of the first plate portion 11 and the second plate portion 12. A plurality of a surrounding positioning slots 142 are provided around each center positioning slot 141 such that each plurality of surrounding positioning slots 142 form points of a circle with the center positioning slot 141 at its center. In the embodiment illustrated in FIG. 1 has six surrounding positioning slots around the respective center positioning slot 11 to form points of a hexagon. The distance between the center positioning slot 141 and each of its surrounding positioning slot 142 corresponds to the fixed distance between the two protruding posts 23 located at the bottom portion of the handle 2. The adjacent surrounding positioning slots 142 are also located at the fixed distance from each other.

The arrangement of the positioning slots 14 on the second plate portion 12 mirrors that of the first plate portion 11. Taking the first plate portion 11 as an example, the number of the surrounding positioning slots 142 on the first plate portion 11 is six. These six surrounding positioning slots 142 are arranged such that one of the two protruding posts 23 of the handle 2 can be inserted into the center positioning slot 141, and the other of the two protruding posts 23 of the handle 2 can be inserted into any of the respective surrounding positioning slot 142.

The handle 2 can be installed and fixed to the base plate 1 to form various configurations to meet different training requirements and target different muscle groups. Preferably, each of the first plate portion 11 and the second plate portion 12 is further provided with at least one corner positioning slot 143 for allowing the handle 2 to be fixed on the base plate 1 such that the length of the holding section 22 lays perpendicular to the length of the base plate 1. In the embodiments illustrated in FIGS. 1-3, the first and second plate portions 11 and 12 each have four corner positioning slots 143 such that each plurality of corner positioning slots 143 form corners of a rectangle. Preferably, a corner positioning slot 143 and one of the surrounding positioning slots 142 are located on the same vertical line at the fixed distance to accommodate the protruding posts 23 of the handle 2. Also preferably, two of the surrounding positioning slots 142 are located on the same horizontal line with the center positioning slot 141 and at the fixed from the center positioning slot so as to allow the handle 2 to be arranged parallel to the length of the base plate 1.

Further, in order to facilitate the user's understanding of what muscle groups are being targeted according to various arrangements of the handles 2, an area between each pairs of positioning slots 14 that are at a fixed distance from each other on the base plate 1 may be marked to indicate which muscle groups are targeted when a user performs pushups while the handle 2 is arranged on the respective pair of positioning slots 14. According to an embodiment, color coded lines between pairs of positioning slots 14 may be used for this purpose. According to another embodiment, areas between pairs of positioning slots may be letter or character-coded. Other ways of distinguishing various positions for the handle 2 may be used. As shown in FIG. 3, which illustrates a letter-coded embodiment, the letter A between two positioning slots 14 indicates that one handle 2 may be placed at position A on the first plate portion 11 and the other handle 2 can be placed in a corresponding (i.e. mirroring) position A on the second plate portion 12, such that performing push ups in this configuration would target the shoulder muscles.

The letter B between two positioning slots 14 indicates that one handle 2 may be placed at position B on the first plate portion 11, and the other handle 2 can be placed in a corresponding position B on the second plate portion 12, such that performing push-ups in this configuration would target the back muscles.

The letter C between two positioning slots 14 indicates that one handle 2 may be placed at position C on the first plate portion 11, and the other handle 2 can be placed in a corresponding position C on the second plate portion 12, such that performing push-ups in this configuration would target the chest muscles.

The letter D between two positioning slots 14 indicates that one handle 2 may be placed at position D on the first plate portion 11, and the other handle 2 can be placed in a corresponding position D on the second plate portion 12, such that performing push-ups in this configuration would target the arm muscles.

The quantity of letters as shown in FIG. 3 indicates the number of placement positions that can be selected for the handle 2 for exercise by a user as described above. A user can also place the handles 2 in non-mirroring positions according to the user's specific situation. A user may also combine these training sites for comprehensive training. This push-up board is highly functional and easy to use.

According to an embodiment, the base plate 1 has a substantially rounded rectangle form. One side portion of the first plate portion 11 and one side portion of the second plate portion 12 are arced so as to avoid the damage that may be easily caused by the corners of the rectangular base plate 1.

Figure 2:
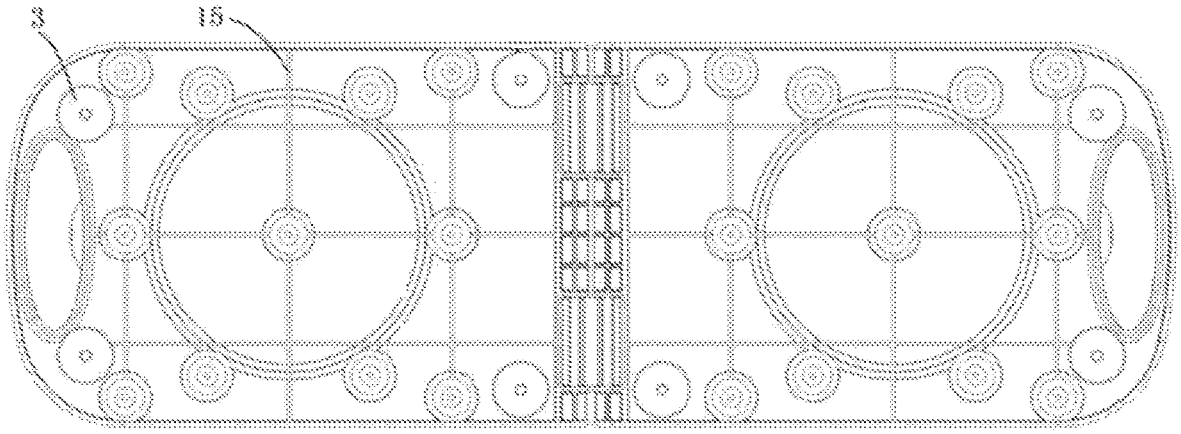
FIG. 2 illustrates an orthogonal bottom view of a foldable push-up board, in accordance with an embodiment of the present disclosure.

As shown in FIG. 2, a bottom portion of the base plate 1 is provided with crisscrossed enhancement ribs 15. The arrangement of the enhancement ribs 15 is beneficial to increase the structural strength of the base plate 1 and to prevent the base plate 1 from being damaged when a user exerts excessive force during exercise.

The two handles 2 are detachably fixed on the first plate portion 11 and the second plate portion 12. According to an embodiment, each handle 2 comprises a U-shaped connecting section 21 fixed to the base plate 1 and a holding section 22 that closes the opening of the U-shaped connecting section 21. According to an embodiment, the holding section 22 has an upper surface, a bottom surface, and two side inwardly angled posts connecting the upper surface and the bottom surface. As mentioned earlier, the upper surface of the holding section 22 may be curved to or contoured to accommodate palm grip. The inwardly angled rectangular surfaces are ergonomic to assist with hand grip. Compared with other existing circular holding sections on the market, the holding section 22 of the present application is more comfortable. Preferably, the handles 2 can be made of non-slip material and have a certain degree of flexibility to improve the comfort when held by a user.

The anti-slip plugs 3 are detachably fixed to a bottom facing portion of the base plate 1. A bottom portion of the anti-slip plug 3 protrudes from the bottom surface of the base plate 1 to improve the anti-slip effect.

In some embodiments of the present utility model, a plurality of anti-slip plugs 3 is provided, and the plurality of anti-slip plugs 3 is arranged in a staggered manner with respect to the positioning slots 14.

In some embodiments of the present utility model, the anti-slip plugs 3 are detachably fixed to the bottom portion of the base plate 1. When an anti-slip plug 3 deteriorates due to long term use, it may be replaced with a new anti-slip plug 3 so as to improve the service life and safety of use of the foldable push-up board 17.

Preferably, the anti-slip plugs 3 are symmetrically distributed at bottom portions of the first plate portion 11 and the second plate portion 12, which helps to ensure that the anti-slip effects of the first plate portion 11 and the second plate portion 12 are symmetric. In some embodiments of the present utility model, the number of anti-slip plugs 3 is 8, and the first plate portion 11 and the second plate portion 12 are each provided with four anti-slip plugs 3, the four anti-slip plugs 3 respectively disposed at the four corners of the first plate portion 11 and the second plate portion 12.

In some embodiments of the present utility model, as shown in FIG. 1, the anti-slip plug 3 comprises a cylindrical body and a pad formed on the bottom surface of the cylindrical body. The cylindrical body comprises a plurality of concentric cylinders 31 therein. The pad of the anti-slip plug 3 has a diameter greater than that of the cylindrical body. The bottom portions of the first plate portion 11 and the second plate portion 12 are provided with a plurality of a cylindrical groove adapted to the shape of the cylindrical body of the anti-slip plug 3. The plurality of the anti-slip pad 3 is detachably fixed to the bottom portions of the first plate portion 11 and the second plate portion 12. Preferably, the anti-slip plugs 3 are made of a flexible material, which can be squeezed and deformed and filled in the cylindrical groove at the bottom portions of the first plate portion 11 and the second plate portion 12. The shape and structure of the anti-slip plug 3 are not limited to the scope defined by the present application.

The present utility model has been described in detail above with reference to the drawings and embodiments. A person of ordinary skill in the art can make various changes to the present utility model based on the above description. Therefore, some details in the embodiments should not constitute a limitation to the present utility model. The scope defined by the appended claims should be regarded as the scope of protection of the present utility model.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the disclosure is anticipated to hold on to all other such alternatives, modifications, and variations that fall within the scope of the present disclosure and appended claim.

I claim:

1. A foldable push-up board comprising:

a base plate comprising:

a first plate portion comprising a first hand-carrying hole, a second plate portion comprising a second hand-carrying hole, and a hinge connecting the first plate portion and the second plate portion, the first hand-carrying hole and the second hand-carrying hole located at each respective end of the first plate portion and the second plate portion such that a single hand-carrying handle is formed when the base plate is completely folded about the hinge;

a first handle and a second handle configured to be detachably fixed to the base plate, each of the first handle and the second handle comprising:

a U-shaped connecting section comprising a plurality of protruding posts configured to be detachably fixed to the base plate, and a holding section that closes an opening of the U-shaped connecting section, the holding section comprising an upper surface, a bottom surface, and two inwardly angled posts connecting the upper surface and the bottom surface; and at least one anti-slip plug detachably fixed to the base plate, wherein a bottom portion of the anti-slip plug protrudes from a bottom-facing surface of the base plate.

2. The foldable push-up board according to claim 1, wherein:

each plurality of protruding posts comprise a first protruding post and a second protruding post, wherein the first protruding post is located at a predetermined length from the second protruding post.

3. The foldable push-up board according to claim 2, wherein:

the first plate portion further comprises a first center positioning slot surrounded by a first plurality of surrounding positioning slots, each surrounding positioning slot of the first plurality of surrounding positioning slots placed at the predetermined length from the first center positioning slot and also adjacent surrounding positioning slots, and the second plate portion further comprises a second center positioning slot surrounded by a second plurality of surrounding positioning slots, each surrounding positioning slot of the second plurality of surrounding positioning slots placed at the predetermined length from the second center positioning slot and also adjacent surrounding positioning slots.

4. The foldable push-up board according to claim 3, wherein:

the first plurality of surrounding positioning slots comprise six surrounding positioning slots arranged in a regular hexagon, and the second plurality of surrounding positioning slots comprise six surrounding positioning slots arranged in a regular hexagon.

5. The foldable push-up board according to claim 1, wherein the first plate portion and the second plate portion each comprises a corner positioning slot located at a predetermined distance from a respective surrounding positioning slot for fixing the handles in a direction that is perpendicular to the length of the base plate.

6. The foldable push-up board according to claim 1, wherein the number of the at least one anti-slip plug is plural and the plurality of anti-slip plugs are arranged in a staggered manner with respect to positioning slots.

7. The foldable push-up board according to claim 6, wherein the anti-slip plugs are symmetrically distributed at bottom portions of the first plate portion and the second plate portion.

8. The foldable push-up board according to claim 1, wherein the anti-slip plug is fixed to the base plate by insertion.

9. The foldable push-up board according to claim 1, wherein a bottom portion of the base plate is provided with crisscrossed enhancement ribs.

* * * * *